US010889308B2

(12) United States Patent
Rodet

(10) Patent No.: US 10,889,308 B2
(45) Date of Patent: Jan. 12, 2021

(54) RAILWAY VEHICLE BOGIE COMPRISING AXLES RIGIDLY FIXED TO THE BODY OF THE BOGIE

(71) Applicant: ALSTOM TRANSPORT TECHNOLOGIES, Saint-Ouen (FR)

(72) Inventor: Alain Rodet, Chalon sur Saône (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 303 days.

(21) Appl. No.: 15/925,983

(22) Filed: Mar. 20, 2018

(65) Prior Publication Data

US 2018/0273058 A1 Sep. 27, 2018

(30) Foreign Application Priority Data

Mar. 22, 2017 (FR) ..... 17 52349

(51) Int. Cl.

| | |
|---|---|
| ***B61F 5/52*** | (2006.01) |
| ***B61F 3/04*** | (2006.01) |
| ***B61B 9/00*** | (2006.01) |
| ***B61B 13/00*** | (2006.01) |
| ***B61F 5/28*** | (2006.01) |

(52) U.S. Cl.

CPC ..... *B61F 5/52* (2013.01); *B61B 9/00* (2013.01); *B61B 13/00* (2013.01); *B61F 3/04* (2013.01); *B61F 5/28* (2013.01)

(58) Field of Classification Search

CPC ..... B61F 5/52; B61F 5/28; B61F 3/00; B61F 3/04; B61B 9/00; B61B 13/00

See application file for complete search history.

(56) References Cited

U.S. PATENT DOCUMENTS

| | | | | |
|---|---|---|---|---|
| 2,036,194 A * | 4/1936 | Burrows | B61F 3/06 105/118 |
| 2002/0195018 A1* | 12/2002 | Eche | B61C 9/52 105/158.2 |
| 2010/0083866 A1* | 4/2010 | Rodet | B61F 3/04 105/34.1 |
| 2010/0307370 A1* | 12/2010 | Rodet | B61C 9/44 105/96.1 |

(Continued)

FOREIGN PATENT DOCUMENTS

| | | |
|---|---|---|
| FR | 1310469 | 10/1962 |
| FR | 2169448 | 9/1973 |

OTHER PUBLICATIONS

Preliminary Search Report dated Dec. 4, 2017 during the prosecution of French Patent Application No. 1752349.

*Primary Examiner* — Jason C Smith

(74) *Attorney, Agent, or Firm* — Troutman Pepper Hamilton Sanders LLP

(57) ABSTRACT

The railway vehicle bogie, comprising a body and two axles, the body comprising two beams extending in a longitudinal direction, each axle comprising a pair of wheels each provided with a tire and a connecting device extending between said wheels, each axle comprising an axle box extending in a transverse direction substantially perpendicular to the longitudinal direction and at least partially surrounding the connecting device. The beams of the body are connected to each other by the axles, the axle box of each axle being rigidly fixed to each of said beams.

11 Claims, 3 Drawing Sheets

(56) References Cited

U.S. PATENT DOCUMENTS

| | | | | |
|---|---|---|---|---|
| 2010/0307371 | A1* | 12/2010 | Rodet | B61F 5/52 105/133 |
| 2013/0333590 | A1* | 12/2013 | Rodet | B61F 5/50 105/182.1 |
| 2016/0023671 | A1* | 1/2016 | Tachibana | B61B 13/00 105/216 |
| 2016/0167681 | A1* | 6/2016 | Rodet | B61F 3/00 105/139 |
| 2016/0207548 | A1* | 7/2016 | Katahira | B61B 13/00 |
| 2016/0272222 | A1* | 9/2016 | Katahira | B61B 13/00 |
| 2016/0355059 | A1* | 12/2016 | Katahira | B61F 9/00 |
| 2017/0113706 | A1* | 4/2017 | Sanchez | B61F 3/125 |
| 2018/0273058 | A1* | 9/2018 | Rodet | B61F 5/52 |
| 2019/0047596 | A1* | 2/2019 | Kanno | B61F 9/00 |

* cited by examiner

RAILWAY VEHICLE BOGIE COMPRISING AXLES RIGIDLY FIXED TO THE BODY OF THE BOGIE

CROSS-REFERENCE TO RELATED APPLICATIONS

The present application claims priority from French Patent Application No. 1752349 filed Mar. 22, 2017. The entire contents of which are incorporated herein by reference.

FILED OF THE INVENTION

The present invention relates to a railway vehicle bogie of the type comprising a body and two axles, the body comprising two beams extending in a longitudinal direction, each axle comprising a pair of wheels each provided with a tire and a connecting device extending between said wheels, each axle comprising an axle box extending in a transverse direction substantially perpendicular to the longitudinal direction and at least partially surrounding the connecting device.

The invention also relates to a railway vehicle of the type described above.

BACKGROUND

Such a bogie, in which the wheels are provided with a tire, called carrier tire, is particularly intended for a railway vehicle of the subway or tram type, traveling on rolling tracks.

In such a bogie, the resilience of the tires can be used to simplify the structure of the bogie by not providing suspension elements between the body and the axles, since the function of these elements can be performed by the tires.

However, it is nevertheless necessary to provide resilient elements in the bogie so as to allow the latter to experience torsion in the longitudinal direction. Indeed, this feature is necessary to allow the bogie to pass distorted track areas, i.e., areas where the points of contact of the wheels of the bogie with the ground are not in a same plane, particularly if a carrier tire blows out.

Thus, the structure of the bogie remains complex due to the need either to resiliently articulate different parts of the body of the bogie to one another, or to introduce a so-called primary suspension chain between the body and the axles. In the first case, it is in particular provided to articulate the beams resiliently to one or more cross-pieces connecting the beams to each other. Consequently, the assembly of the bogie is complicated by the mounting of resilient articulation elements or by the mounting of primary suspensions.

SUMMARY

One aim of the invention is to overcome these drawbacks by proposing a simplified bogie structure with easier assembly.

To that end, the invention relates to a bogie of the aforementioned type, wherein the beams of the body are connected to one another by the axles, the axle box of each axle being rigidly fixed to each of said beams.

By providing a bogie with beams extending in the longitudinal direction connected to one another by axle boxes, i.e. the body of which does not comprise an additional cross-piece connecting the beams to one another, it is possible to take advantage of the flexibility of the beams to give the bogie the ability to undergo torsion around a longitudinal axis with no resilient articulation element in the body of the bogie or between the beams and the axles. Thus, the axle boxes can be rigidly fastened to the beams, i.e., without resilient articulation elements, which simplifies the structure of the bogie and its assembly. The invention therefore makes it possible to go from a bogie with an articulated body or a bogie with a primary suspension to a flexible bogie, while retaining the same capacities in terms of suspension and torsion.

According to other advantageous features of the bogie according to the invention, considered alone or according to any technically possible combination:

- each beam has a flexibility such that the bogie has a degree of flexional freedom around a longitudinal axis substantially parallel to the beams and extending between said beams;
- each beam has a cross-section comprising a core extending in an elevation direction substantially perpendicular to the longitudinal and transverse directions and two branches extending in a substantially transverse direction on either side of the core in the elevation direction;
- the axle box of each axle is fixed to each beam by at least one screw or bolt;
- the connection between the body and the axles has no articulation or elastic suspension element;
- each beam comprises, at each of its longitudinal end parts, a guide wheel support, said longitudinal end parts extending in a substantially transverse direction relative to the rest of the beam;
- the bogie further comprises a motor extending between the beams and between the axles and a motor housing extending at least partially around the motor;
- the beams of the body are connected to one another by the motor housing, said motor housing being rigidly fixed to each of said beams; and
- the connecting device between the wheels of each axle comprises a reducing gear connecting the motor to each of the wheels, said reducing gear being housed in the axle box between the beams.

The invention also relates to a railway vehicle comprising a bogie as described above.

BRIEF DESCRIPTION OF THE DRAWINGS

Other aspects and advantages of the invention will appear upon reading the following description, provided as an example, and done in reference to the appended drawings, in which.

DETAILED DESCRIPTION

In the description, the term "longitudinal" is defined relative to the direction of travel of a railway vehicle, i.e. the direction in which the rolling tracks, on which the railway vehicle travels, extend. The term "transverse" is defined by a direction corresponding to the width of a railway vehicle, i.e., a direction substantially perpendicular to the longitudinal direction and extending in a horizontal plane when the railway vehicle travels on horizontal rolling tracks. The term "elevation" is defined by a direction substantially perpendicular to the longitudinal and transverse directions, i.e., a substantially vertical direction when the railway vehicle travels on horizontal rolling tracks.

Figure 1:
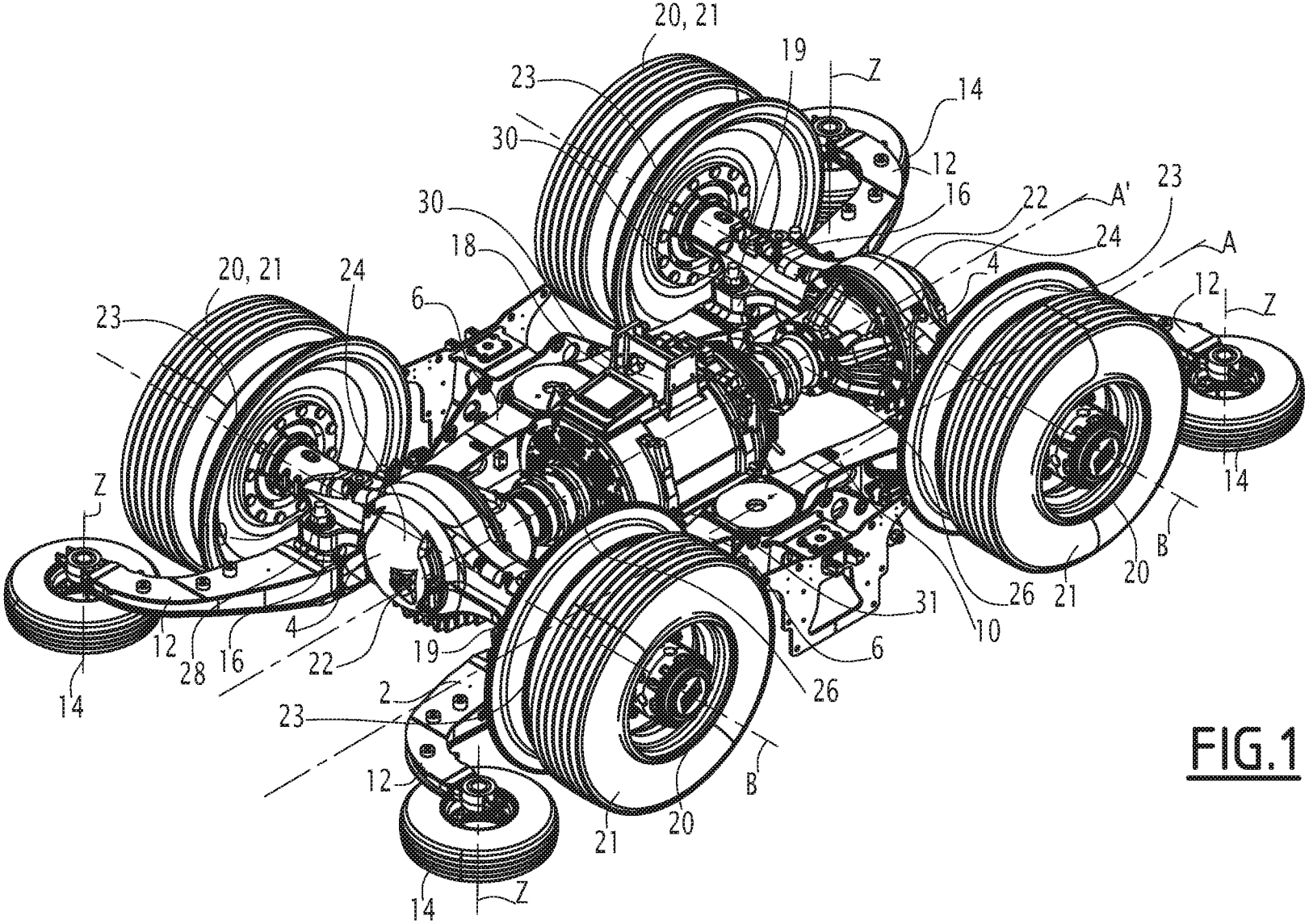
FIG. 1 is a schematic perspective illustration of a bogie according to the invention.

In reference to FIG. 1, a railway vehicle bogie 1 is defined comprising a body 2 and two axles 4 mounted on the body 2.

The body 2 comprises two beams 6 each extending in a longitudinal direction and spaced apart from one another in the transverse direction. Each beam 6 is formed by a metal profile, for example made from steel.

Figure 3:
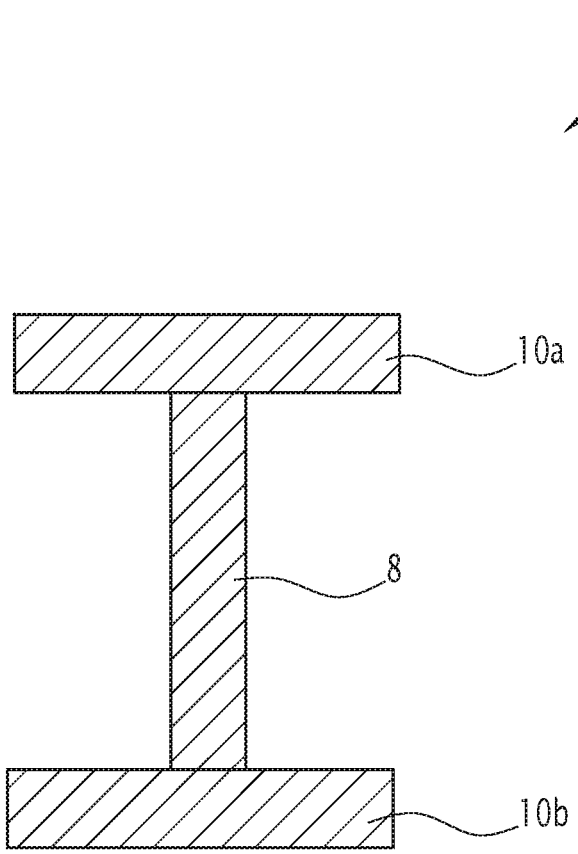
FIG. 3 is a schematic sectional illustration along axis of FIG. 2.

The profile is I-shaped in cross-section, i.e., in a plane extending in a transverse direction and in an elevation direction, as shown in FIG. 3. Thus, the cross-section of the beam 6 has a core 8 extending in a plane extending in the longitudinal direction and in the elevation direction and two branches 10 extending on either side of the core 8. The branches 10 extend in planes substantially perpendicular to the plane of the core 8, i.e., planes extending in the longitudinal direction and in the transverse direction. Thus, the profile comprises an upper branch 10*a* and a lower branch 10*b* respectively extending above and below the core 8 in the elevation direction. Such a profile shape makes it possible to impart a certain suppleness or flexibility to the beam 6 in the longitudinal direction. Thus, the beam 6 is able to undergo torsion around an axis A extending in the longitudinal direction along the core 8 substantially equidistantly from the two branches 10. According to one embodiment, the torsion around the axis A can go up to 1° for a bogie with a wheel base of substantially 2 m. Such torsion in particular occurs when crossing a distorted track area of 10 mm/m while traveling on auxiliary wheels or if a carrier tire blows out, as will be described later. The beam used in the bogie according to the invention does not have a closed section, like in the case of beams having a box structure, which allows it to impart this torsional capacity, unlike beams having a box structure, which are particularly rigid. Thus, although the profile previously described is I-shaped, it is understood that this profile could have a different shape as long as this shape is suitable so that the beam has a certain suppleness or flexibility around its longitudinal axis A.

Figure 2:
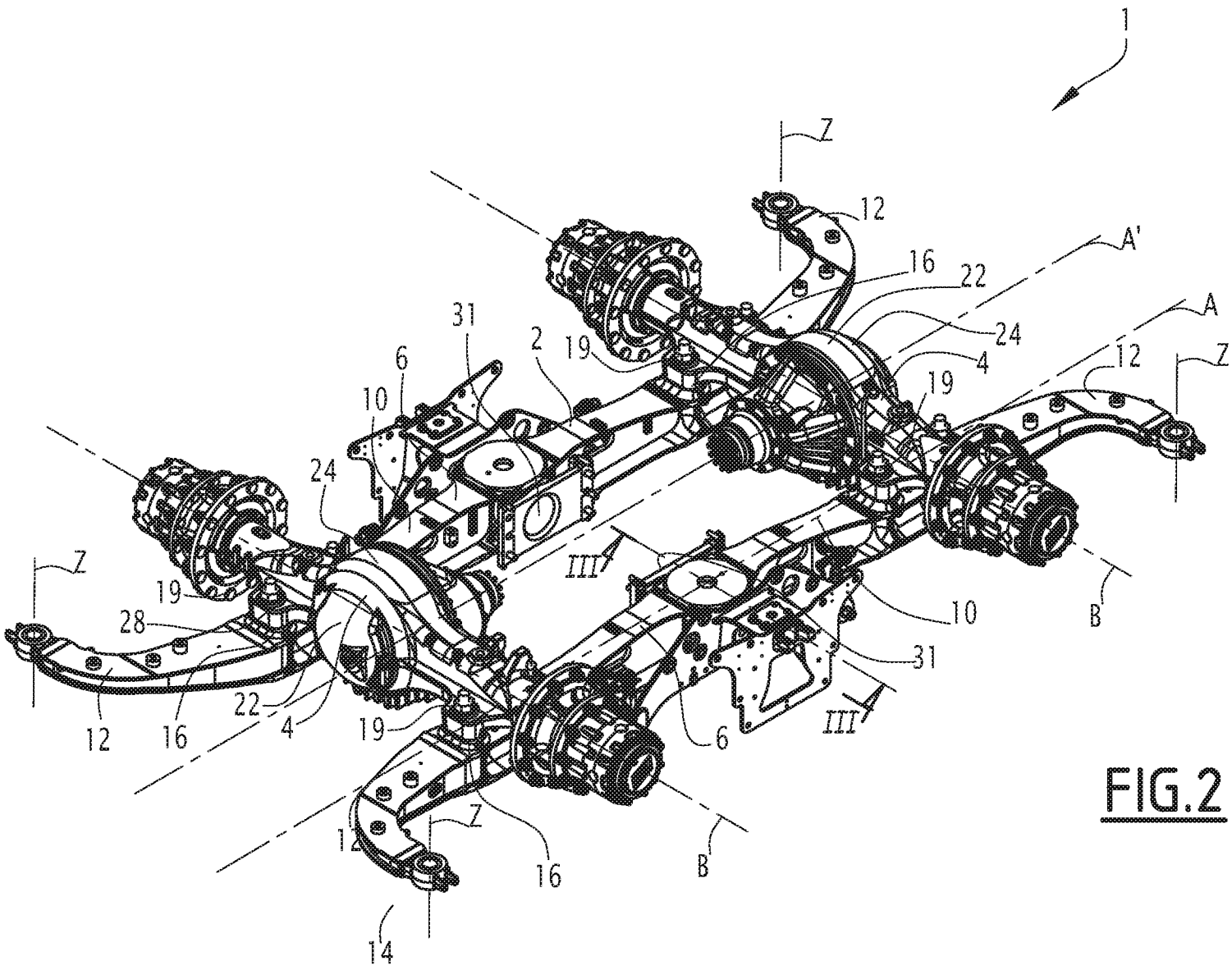
FIG. 2 is a schematic perspective illustration of the bogie of FIG. 1, in which the wheels have been removed.

According to the embodiment shown in FIGS. 1 and 2, each beam 6 has two longitudinal end parts 12 extending at each end of the beam 6 in the longitudinal direction. The longitudinal end parts 12 each extend in a transverse direction toward the outside of the bogie 1. The longitudinal end parts 12 are arranged each to carry a guide wheel 14, as shown in FIG. 1. Each guide wheel 14 extends substantially transversely and is arranged to bear against a guide surface (not shown) extending on one side of the rolling tracks on which the railway vehicle is traveling. Indeed, in the case of a bogie comprising wheels bearing tires, as will be described later, the railway vehicle does not travel continuously on rails and guiding of the bogie is necessary, in particular on turns, and this guiding can be done by guide surfaces extending on either side of the rolling tracks, and by the contact of the guide wheels 14 with these guide surfaces. The guide wheels 14 are for example each provided with a tire and rotatable around an axis Z extending in the elevation direction relative to the longitudinal end parts 12.

Each beam 6 further comprises fixing areas 16 making it possible to fix axles 4 and optionally a motor 18, as will be described later. The fixing areas 16 are for example provided with one or several orifices in the upper branch 10*a* making it possible to screw a screw 19 or to bolt a bolt in the branch, as will be described later.

Each axle 4 comprises two wheels 20 connected to a connecting device positioned in an axle box 22.

Each wheel 20 extends at a transverse end of the axle 4 such that the wheels 20 of an axle 4 extend on either side of the beams 6 of the body 2, as shown in FIG. 1. Each wheel 20 is provided with a tire 21, called carrier tire, and is rotatable around a rotation axis B extending in a substantially transverse direction. Each axle 4 may further comprise two auxiliary wheels 23 each positioned next to one of the wheels 20. Such auxiliary wheels 23 are arranged to allow travel on rails, for example in areas with no running rack for the carrier tires 21.

The connecting device extends transversely from one wheel 20 to the other (or from one auxiliary wheel 23 to the other) and is for example formed by one or several shafts secured in rotation with the wheels 20, and for example rotated by a reducing gear 24 positioned between the beams 6 in the case of a motor bogie, as will be described later.

The shaft(s) and the reducing gear 24 are housed, at least partially and rotatably, in the axle box 22, which extends at least from one beam 6 to the other. The axle box 22 therefore forms a sheath, the shape of which is suitable for receiving the shaft(s) and the reducing gear 24. At the reducing gear 24, the axle box 22 is for example opened for the passage of an input shaft 26 of the reducing gear 24. The axle box 22 is rigidly fixed to each beam 6 and provides a connection between these beams 6. Rigid fixing means that the axle box 22 is not movable relative to the beams 6. Thus, there is no suspension or resilient articulation element provided between the axle box 22, and more generally the axle 4, and the beams 6. The fixing of the axle box 22 to a beam 6 is done in a fixing area 16 of the latter for example by screwing at least one screw 19 or by bolting a bolt traversing a platen 28 of the axle box 22 in the orifice provided to that end in the upper branch 10*a* of the beam. According to one embodiment shown in FIGS. 1 and 2, the fixing of the axle box 22 of an axle 4 on a beam 6 is done by two screws 19 extending all the way through the axle box 22 in the longitudinal direction. It should be noted that the figures show a bogie 1 in which the axles 4 are fixed on the upper branch 10*a* of the beams 6, the axles therefore extending above the beams 6. However, according to another embodiment, the axles 4 could be fixed on the lower branch 10*b* of the beams 6 and extend below the latter.

The axle boxes 22 are rigidly fixed to the beams 6, each near a longitudinal end part 12 of the beams 6, such that the axles 4 and the beams 6 form a rigid frame in the elevation direction and in the transverse direction. This assembly is, however, able to undergo torsion around a longitudinal axis A' extending substantially equidistantly from the beams 6 between them due to the flexibility of the beams 6 in this longitudinal direction, as previously described. The bogie 1 according to the invention is therefore able to bear efforts in the elevation direction owing to the resiliency of the tires 21 and to pass track distortions owing to this ability to undergo torsion around a longitudinal axis even when the bogie 1 has no suspension element and resilient articulation element.

According to the embodiment shown in FIGS. 1 and 2, the bogie 1 is a motor bogie comprising a motor 18 arranged to drive the rotation of the wheels 20 via reducing gears 24.

Traditionally, the motor 18 is connected to the reducing gears via input shafts 26. The motor 18 is placed, at least partially, in a motor housing 30 extending substantially transversely from one beam 6 to the other and placed, in the longitudinal direction, between the axles 4. The motor housing 30 is fixed rigidly to each of the beams 6. Like for the axles 4, rigid fixing means that the motor housing 30 is not movable relative to the beams 6 and that there is no suspension or resilient articulation element provided between the motor housing 30 and the beams 6. According to one embodiment, the motor housing 30 is fixed by screwing or bolting in a fixing area 31 of the beams 6. Thus, the motor housing 30 also participates in connecting the beams 6 to each other.

It will be noted that the bogie body 2 described above comprises only two beams 6 and no mechanically welded connection between these two beams, such as a cross-piece or the like, this function being performed by the axle boxes 22, and optionally the motor housing 30. Such a body structure makes it possible to give the latter the desired flexibility around the longitudinal axis A', in particular when crossing track distortions when the bogie is traveling on auxiliary rails 23 or if a carrier tire 21 blows out. The mounting of the body is thus particularly simple, since it can be obtained by simple screwing or bolting operations. As an example, eight screwing or bolting operations are sufficient to obtain the bogie when each axle housing 22 is fixed to each beam 6 by two screws or two bolts.

The bogie has been described as comprising a motor 18, i.e., a motor bogie, driving the rotation of the wheels 20 of the two axles 4. It is, however, understood that the invention could apply to a motorless bogie, the wheels of which are rotated due to the driving by another motorized bogie, or to a bogie whose motor only rotates the wheels of a one axle 4 of the two.

The invention also relates to a railway vehicle comprising one or more bogies as described above. Such a railway vehicle is for example a subway or a tram arranged to travel on running racks at least partially provided without rails and comprising guide surfaces on the sides, in at least some areas.

The invention claimed is:

1. A railway vehicle bogie, comprising a body and two axles, the body comprising two beams extending in a longitudinal direction, each axle comprising a pair of wheels each provided with a tire and a connecting device extending between said wheels, each axle comprising an axle box extending in a transverse direction substantially perpendicular to the longitudinal direction and at least partially surrounding the connecting device, wherein the beams of the body are connected to each other by the axles, the axle box of each axle being rigidly fixed to each of said beams, wherein each beam extends between both axles, the beams are connected to each other by the axles, and wherein each beam has a cross-section comprising a core extending in an elevation direction substantially perpendicular to the longitudinal and transverse directions and two branches extending in a substantially transverse direction on either side of the core in the elevation direction.

2. The railway vehicle bogie according to claim 1, wherein each beam has a flexibility such that the bogie has a degree of flexional freedom around a longitudinal axis substantially parallel to the beams and extending between said beams.

3. The railway vehicle bogie according to claim 1, wherein the axle box of each axle is fixed to each beam by at least one screw or bolt.

4. The railway vehicle bogie according to claim 1, wherein the connection between the body and the axles has no articulation or elastic suspension element.

5. The railway vehicle bogie according to claim 1, wherein each beam comprises, at each of its longitudinal end parts, a guide wheel support, said longitudinal end parts extending in a substantially transverse direction relative to the rest of the beam.

6. The railway vehicle bogie according to claim 1, further comprising a motor extending between the beams and between the axles and a motor housing extending at least partially around the motor.

7. The railway vehicle bogie according to claim 6, wherein the beams of the body are connected to one another by the motor housing, said motor housing being rigidly fixed to each of said beams.

8. The railway vehicle bogie according to claim 6, wherein the connecting device between the wheels of each axle comprises a reducing gear connecting the motor to each of the wheels, said reducing gear being housed in the axle box between the beams.

9. A railway vehicle comprising at least one bogie according to claim 1.

10. The railway vehicle bogie according to claim 1, wherein each beam is able to undergo torsion around an axis A extending in the longitudinal direction along the core substantially equidistantly from the two branches.

11. The railway vehicle bogie according to claim 1, wherein the elevation direction of the core defines a symmetry axis of each branches.

* * * * *